United States Patent [19]

Tilby

[11] Patent Number: 5,016,604

[45] Date of Patent: May 21, 1991

[54] STRING SILENCERS FOR ARCHERY BOWS

[75] Inventor: V. John Tilby, Salt Lake City, Utah

[73] Assignee: Sportsmen's Outdoor Products, Salt Lake City, Utah

[21] Appl. No.: 493,131

[22] Filed: Mar. 13, 1990

[51] Int. Cl.[5] ..... F41B 5/00

[52] U.S. Cl. ..... 124/92

[58] Field of Search ..... 124/92, 90, 91, 23.1

[56] References Cited

U.S. PATENT DOCUMENTS

| | | | |
|---|---|---|---|
| 2,956,560 | 10/1960 | Stockfleth | 124/90 X |
| 3,059,629 | 10/1962 | Stinson | 124/23.1 |
| 3,612,029 | 10/1971 | Carroll et al. | 124/92 |
| 3,756,214 | 9/1973 | Christen | 124/92 X |
| 3,837,327 | 9/1974 | Saunders et al. | 124/92 |
| 4,023,551 | 5/1977 | Huddleston | 124/92 |
| 4,080,951 | 3/1978 | Bateman, III . | |

OTHER PUBLICATIONS

P. 31 of the Browning Archery Products Catalog (1989).

*Primary Examiner*—Peter M. Cuomo
*Attorney, Agent, or Firm*—Trask, Britt & Rossa

[57] ABSTRACT

A string silencer for an archery bow is fashioned from double-faced fleece polyester fabric. It is formed as a rectangular sheet with matched sets of legs extending oppositely from a body portion. The body portion is inserted on a parting plane between equal portions of a bowstring. Individual pairs of legs are tied in alternating fashion to the respective bowstring portion.

9 Claims, 2 Drawing Sheets

STRING SILENCERS FOR ARCHERY BOWS

BACKGROUND OF THE INVENTION

1. Field

This invention pertains to archery bows, and is particularly directed to string silencers for use with such bows.

2. State of the Art

It is known that when an arrow is launched from the bowstring of an archery bow, the string tends to generate noise. A principal cause of such noise is the vibration of the string itself. Noise may also result from the uncushioned contact by the string of other structural components of the bow, notably the end stretch cables of a compound bow.

String silencers of various design have been used heretofore to dampen the vibration of the bowstring resulting from arrow launch. U.S. Pat. No. 4,080,951, for example, discloses an archery bowstring silencer comprising a multitude of lengths of fibers connected at their midpoints to a flexible support. The support, typically a strip of leather, is wound helically around a bowstring or cable and fastened in place near a limb tip. In this way, the fiber lengths collectively form a soft, ball-like projection which can contact the bow limb upon release of the string from a drawn condition.

Other string silencers available to archers commercially include those commonly called "puff string silencers" or "puffs." These devices are soft balls resembling the tied-in-place silencers of U.S. Pat. No. 4,080,951. They are preformed, however, and are installed by separating the strands of a bowstring and inserting ties connected to the puff. "Cat whisker silencers" are also available, consisting of a plurality of thin rubber appendages extending from a body which is tied to the bowstring.

Each of the string silencers currently in use is intended to dampen vibration and reduce noise without negatively impacting on the performance of the bow. In fact, while all of these devices are generally effective, each has certain drawbacks, particularly under certain conditions. For example, arrow velocity appears to be negatively affected in most bows equipped with any of the currently available silencers. Silencers, such as puffs and those of U.S. Pat. No. 4,080,951, which are constructed of yarn or other water absorptive fabrics, are less effective in damp or wet weather. None of the available silencers are entirely effective in eliminating string noise; moreover, they tend to dislodge during use due to strain imposed upon the structures used to connect them to the bowstring.

There remains a need for an improved string silencer for archery bows which will more nearly achieve the objectives of such devices while avoiding the shortcomings of prior art string silencers.

SUMMARY OF THE INVENTION

The present invention provides an improved string silencer for archery bows. It is structured to effect excellent and reliable attachment to a bowstring. In its preferred embodiments, it is fashioned from material which retains its silencing capabilities when used in wet conditions and which has superior quieting properties whether wet or dry.

In general, the string silencer of this invention may be formed from a sheet of soft, resilient fabric material, preferably of a type which is essentially non-absorbent with respect to water (typically less than about one percent by weight). The sheet should be relatively thin, ideally less than about ¼ inch thick. The fabrics known commercially as "fleece," (a polyester double-napped fleece being preferred), are generally suitable. Each silencer may be formed by cutting an appropriately sized rectangular sheet of fleece (or its equivalent) from its opposite narrow ends to produce two sets of mutually opposed legs extending from a central body portion. The body and legs together define an approximately rectangular prism. Other shapes are within contemplation, but are not currently believed to offer substantial advantages, particularly from a manufacturing standpoint.

The size of the silencer is not critical, but a practical range comprises silencers fashioned from rectangles measuring between about 1 to about 2½ inches along their narrow sides and between about 4 and about 6 inches along their longer sides. Fleece fabric is available in a variety of colors and patterns, including camouflage. A notable advantage of fleece material is its inherent quietness. That is, it does not itself create any noise when it is deformed or contacts other surfaces, even in extreme cold.

The number of legs provided in each set of opposed legs is similarly not critical, although at least two, and preferably three pair are required to obtain the benefits of the attachment mechanism offered by the invention. It is preferred that the legs be in matched pairs, each leg of each set corresponding to a leg in the other set. Four matched pairs of legs are currently considered adequate for most purposes, but embodiments with six or more matched pairs of legs are within contemplation. Usually, each leg will be less than about ½ inch wide, while lengths in the range of about 1½ to about 3 inches are generally useful.

The silencers of this invention, if attached to the cables of compound bows, will function to reduce cable noise. Nevertheless, they are primarily intended for attachment to the bowstrings of archery bows generally, including longbows, compound archery bows and crossbows.

A silencer of this invention is attached to a bowstring by tying matched pairs of legs to the string. Because each pair of legs is individually tied, the connection is relatively secure during prolonged use. Ideally, a multistrand bowstring is parted, with approximately equal numbers of strands on each side of a parting plane. The silencer is inserted between the separated halves. Each matched pair of legs is then tied, a single knot being sufficient. Alternating pairs of legs are tied to opposite halves of the string fibers. In most cases, two silencers are connected to the bowstring, one near each limb tip, typically about 6 to about 10 inches from the end of the bow limb.

In practice, it has been found that the silencing properties of the silencers of this invention improve with use. It is believed that this improvement results from a readjustment of the material as it is flexed in use. In any event, after several shots, the legs appear to stretch slightly, without loosening.

BRIEF DESCRIPTION OF THE DRAWINGS

In the drawings, which illustrate what is currently regarded as the best mode for carrying out the invention.

DESCRIPTION OF THE ILLUSTRATED EMBODIMENT

Figure 1:
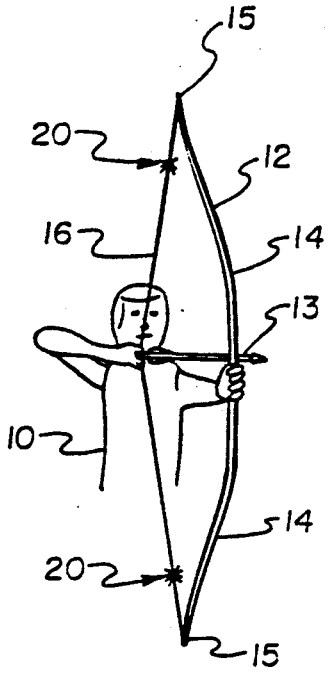
FIG. 1 is a pictorial view of an archer using a conventional longbow equipped with silencers of this invention.

FIG. 1 illustrates an archer 10 holding a longbow 12 and arrow 13. The bow includes a pair of oppositely-extending limbs 14 with tips 15 connected to a string 16. The string 16 is shown in a drawn condition and carrying a pair of string silencers, designated generally 20, in the proximity of the tips 15.

Figure 2:
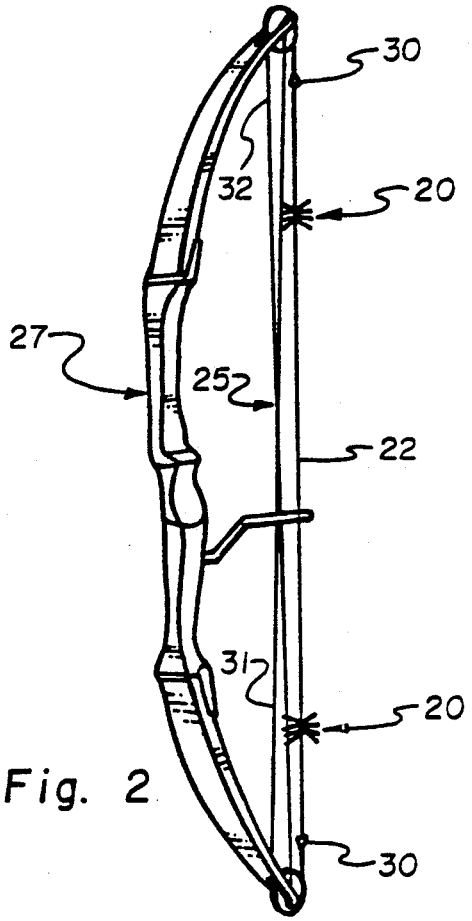
FIG. 2 is a pictorial view of a compound bow equipped with silencers of the invention.

FIG. 2 illustrates a pair of silencers 20, carried by a bowstring 22, constituting the central stretch of the rigging, designated generally 25, of a compound archery bow, designated generally 27. The string 22 is attached to "tear drop" fixtures 30 carried by the respective end stretch cables 31, 32 of the rigging 25.

Figure 3:
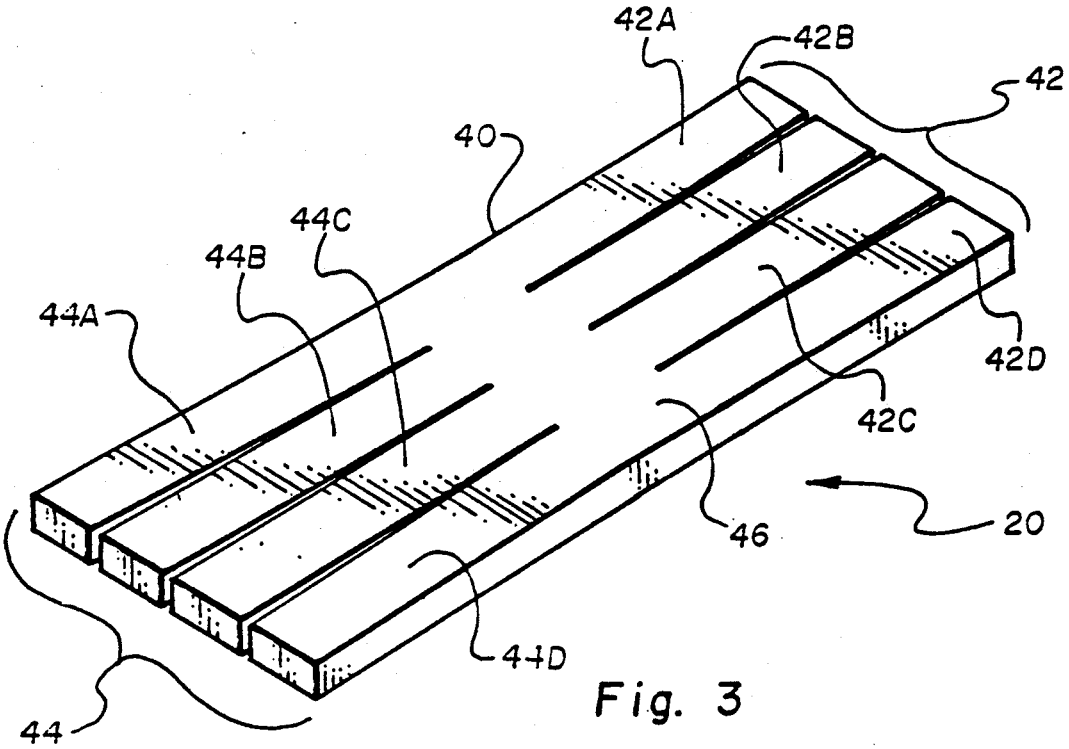
FIG. 3 is a pictorial view of a silencer of this invention.

As best shown by FIG. 3, each silencer 20 comprises an approximately rectangular sheet 40 of polyester double-faced fleece material manufactured by Malden Mills and available from Minnetonka Mills, Hopkins, Minnesota, under the trade name "POLAR PLUS" TM. This material has a softly napped texture and a luxurious furlike hand considered ideal from the standpoint of this invention. It has a slight resilient stretch and absorbs no more than about one percent by weight water. It is relatively easy to cut without tearing and resists unraveling even under hard use. The dimensions of the sheet 40 are approximately 1⅝ inches by approximately 4½ inches.

Two sets of legs 42, 44 extend from a central body portion 46. Each individual leg (42A, 42B, 42C, 42D, 44A, 44B, 44C, 44D) measures approximately ⅝ inches wide by about 2 inches long. The uncompressed sheet 40 is approximately ⅛ inch thick.

Figure 4:
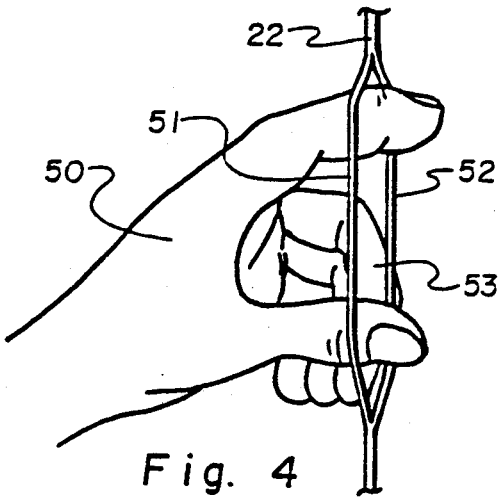
FIG. 4 is a pictorial view of a bowstring being prepared for attachment of a silencer of this invention.
Figure 5:
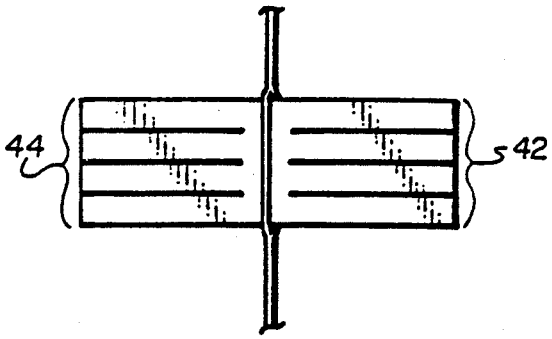
FIGS. 5 through 9 illustrate various steps in the sequence of attaching a silencer of this invention to a bowstring.
Figure 6:
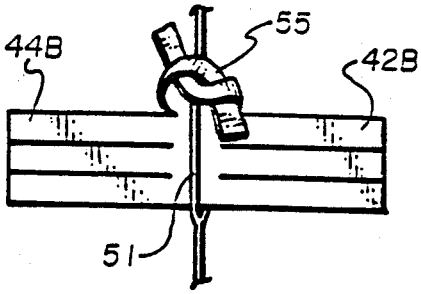
Figure 7:
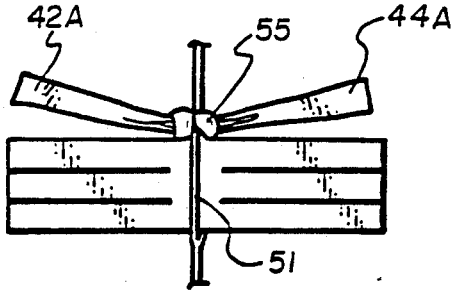
Figure 8:
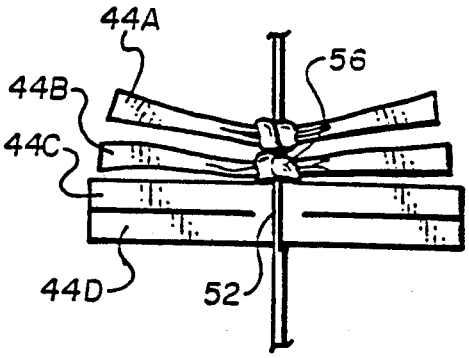
Figure 9:
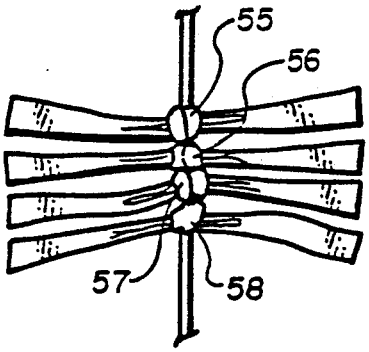

Referring to FIG. 4, a portion of the string 22, about four inches from the tear drop fixture 30, is parted by hand 50 into approximately equal parts 51, 52. The silencer 20 is inserted into the gap 53 so that its body portion 46 is straddled by the string parts 51, 52 (see FIG. 5). The matched pair of legs 42A, 44A are then tied in a single knot 55 (see FIGS. 6 and 7). The matched pair of legs 42B, 44B are then tied in a single knot 56 to the string part 52 (see FIG. 8). Alternating matched pairs of legs from the sets 42, 44 are tied to string parts 51, 52 by single knots 57, 58 to finish the installation, as illustrated by FIG. 9.

A single pair of silencers is effective in reducing the intensity of sound produced by a bowstring launching an arrow. Even greater sound reduction may be achieved by installing a second pair of silencers. Individual silencers of the second pair are desirably spaced a few inches from the corresponding silencers of the first pair. Use of the silencers of this invention has been found to have a negligible impact on the velocity of arrows launched from a bow with which they are used.

Reference herein to details of the illustrated embodiments is not intended to limit the scope of the appended claims which themselves recite the features regarded as important to the invention.

I claim:

1. A silencer for the bowstring of an archery bow comprising a flat sheet of soft resilient fabric material, formed into:

a central body portion;

a first set of legs arranged in a side by side relationship extending from said body portion; and a second set of legs arranged in a corresponding number to said first set of legs and extending normal from said body portion opposite said first set of legs.

2. A silencer according to claim 1, wherein said fabric material is a fleece material.

3. A silencer according to claim 2, wherein said fleece material is essentially non-absorbent with respect to water.

4. A silencer according to claim 1, wherein said fabric material is polyester double-faced fleece material less than about ¼ inch thick.

5. A silencer according to claim 1, wherein said body and legs together define a rectangular prism less than about ¼ inch thick, between about 1 and 2½ inches wide and between about 4 and 6 inches long.

6. A silencer according to claim 5, wherein said silencer includes at least 2 matched pairs of legs.

7. A silencer according to claim 6, wherein said fabric is essentially non-absorbent with respect to water.

8. A silencer according to claim 7, wherein said fabric is a polyester double-faced fleece material.

9. A silencer according to claim 8, wherein said legs are approximately 1½ to about 3 inches in length and less than about ½ inch in width.

* * * * *